US011453032B2

(12) United States Patent
Guo et al.

(10) Patent No.: US 11,453,032 B2
(45) Date of Patent: Sep. 27, 2022

(54) PHOTOELECTRIC COAL AND GANGUE SORTING DEVICE AND SORTING METHOD THEREFOR

(71) Applicant: Anhui University of Science and Technology, Anhui (CN)

(72) Inventors: Yongcun Guo, Anhui (CN); Shuang Wang, Anhui (CN); Jianwen Yan, Anhui (CN); Kun Hu, Anhui (CN); Junpeng Zhou, Anhui (CN)

(73) Assignee: Anhui University of Science and Technology, Huainan (CN)

( * ) Notice: Subject to any disclaimer, the term of this patent is extended or adjusted under 35 U.S.C. 154(b) by 0 days.

(21) Appl. No.: 17/546,966

(22) Filed: Dec. 9, 2021

(65) Prior Publication Data

US 2022/0234077 A1 Jul. 28, 2022

(30) Foreign Application Priority Data

Jan. 23, 2021 (CN) ..... 202110091335.9

(51) Int. Cl.

| | |
|---|---|
| ***B07B 1/46*** | (2006.01) |
| ***B07B 13/16*** | (2006.01) |
| ***B07B 1/14*** | (2006.01) |
| ***B07B 1/42*** | (2006.01) |

(52) U.S. Cl.

CPC ..... *B07B 1/46* (2013.01); *B07B 1/14* (2013.01); *B07B 1/42* (2013.01); *B07B 13/16* (2013.01)

(58) Field of Classification Search

CPC .... B07B 1/14; B07B 1/28; B07B 1/42; B07B 1/46; B07B 13/16; B07C 5/02; B07C 5/34

See application file for complete search history.

(56) References Cited

U.S. PATENT DOCUMENTS 5,108,626 A * 4/1992 Lees ..... B07B 1/46 210/780

2014/0291213 A1* 10/2014 Chen ..... B07C 5/367 209/44.2

* cited by examiner

*Primary Examiner* — Michael McCullough
*Assistant Examiner* — Kalyanavenkateshware Kumar
(74) *Attorney, Agent, or Firm* — Dragon Sun Law Firm, PC; Jinggao Li, Esq.; Nathaniel Perkins

(57) ABSTRACT

The present invention relates to a photoelectric coal and gangue sorting device and a sorting method therefor. The device comprises a support frame, a coal and gangue separation screen body, a sealing upper cover, a sieving mechanism, a driving mechanism, a separating and conveying mechanism, a positioning plate and a sorting unit; the coal and gangue separation screen body, on the top of which is provided with the sealing upper cover and inside of which is provided with the separating and conveying mechanism, is fixedly installed on one side of the support frame by means of bolts; the side wall of the positioning plate, which is arranged above the separating and conveying mechanism, is fixed to the inner wall of the coal and gangue separation screen body by means of spot welding.

10 Claims, 8 Drawing Sheets

PHOTOELECTRIC COAL AND GANGUE SORTING DEVICE AND SORTING METHOD THEREFOR

CROSS-REFERENCE TO RELATED APPLICATION

This application claims priority from the Chinese patent application 202110091335.9 filed Jan. 23, 2021, the content of which is incorporated herein in the entirety by reference.

TECHNICAL FIELD

The present invention relates to the technical field of coal mining equipment, in particular to a photoelectric coal and gangue sorting device and a sorting method therefor.

BACKGROUND

Gangue is a solid waste discharged during coal mining and washing. Associated with coal seams, this dark gray rock is produced in the process of coal forming with low carbon content but harder than coal. Gangue may be obtained in the process of roadway construction, extracted from roof, floor and interlayer in the process of mining, and sorted out in the process of coal washing. The escape or leaching of sulfide in gangue will pollute the atmosphere, farmlands and water bodies; and gangue dumps may spontaneously ignite and start a fire, or collapse in the rainy season, causing silted rivers. In view of this, gangue should be sorted out in the process of coal mining There are many devices to achieve this purpose. Photoelectric coal and gangue sorting device is one of them.

However, photoelectric coal and gangue sorting devices currently available in the market have the following defects in service: a. with the purpose of improving the sorting precision of coal and gangue, existing photoelectric coal and gangue sorting devices are equipped with intelligent sorting units, i.e., sorted in ray penetration; however, sorting devices may cause coal and gangue to fall and stack onto conveying equipment prior to the sorting step in the prior art, and ghosting may occur when stacked coal and gangue fall side by side, causing the inaccurate penetration of rays through the same object; and b. existing photoelectric coal and gangue sorting devices are not able to sieve pulverized coal out quickly before the sorting step, resulting in severe dust in the surrounding environment during the subsequent sorting operations, which can enter the respiratory tract and do harm to the health of operators.

SUMMARY OF THE INVENTION

To solve the above problems, the present invention provides a photoelectric coal and gangue sorting device and a sorting method therefor, which can solve the problems raised in the background art.

To achieve the above purpose, the technical solution adopted by the present invention is as follows: a photoelectric coal and gangue sorting device includes a support frame, a coal and gangue separation screen body, a sealing upper cover, a sieving mechanism, a driving mechanism, a separating and conveying mechanism, a positioning plate and a sorting unit; the coal and gangue separation screen body, on the top of which is provided with the sealing upper cover and inside of which is provided with the separating and conveying mechanism, is fixedly installed on one side of the support frame by means of bolts; the side wall of the positioning plate, which is arranged above the separating and conveying mechanism, is fixed to the inner wall of the coal and gangue separation screen body by means of spot welding; the sorting unit is installed on the right side of the separating and conveying mechanism inside the coal and gangue separation screen body; and the top of the support frame is provided with the sieving mechanism at the bottom of which the driving mechanism is installed.

An arc hole, into which a linkage rod is inserted, is formed on the top of the support frame, a reset spring is welded to the outer wall of the linkage rod, the top of the reset spring is welded to the top of the arc hole, and a reinforcing plate is welded to the inner side of the support frame.

The sieving mechanism includes a sieving hopper with one end welded to an end face of the linkage rod and the other end connected to a top corner of the coal and gangue separation screen body by means of a shaft lever, a sieve is welded at the middle position of the inner wall of the sieving hopper, and a leakage hole is formed at the bottom of the sieving hopper.

The driving mechanism includes shaft brackets symmetrically welded to an upper end face of the reinforcing plate, a rotating shaft is arranged between the two shaft brackets and cams are symmetrically welded to the outer wall of the rotating shaft, a first motor is arranged on one side of the shaft bracket and fixed on an upper end face of the reinforcing plate by means of a motor fixing frame, and an output shaft of the first motor is connected to the rotating shaft by means of a synchronous belt.

The separating and conveying mechanism includes fixing side plates bolted to the bottom end inside the coal and gangue separation screen body, driving discs are symmetrically welded to the outer wall of a rotating shaft arranged between the two fixing side plates, semicircular grooves are provided on outer walls of the driving discs at equal intervals in a circumferential direction, an upper end of the semicircular groove is provided with a drive rod of which the outer wall is sleeved with supporting assemblies side by side, ends of any two adjacent drive rods are connected by means of a rubber block, driving gears are welded to outer walls of the two rotating shafts and connected by means of a driving chain, the second motor is fixed on the outer wall of the coal and gangue separation screen body by means of a motor fixing frame, and the output shaft of the second motor penetrates through the coal and gangue separation screen body and is connected to the rotating shaft.

Furthermore, a supporting assembly includes several supporting blocks sleeved on the outer wall of the drive rod side by side, a tension spring is arranged between rectangular grooves symmetrically provided on two side walls of the supporting block, T-shaped rods are arranged on inner walls of convex grooves formed at the top of the bearing block at equal intervals, supporting springs are symmetrically provided on one end of the T-shaped rod located in the convex grooves, a supporting plate is welded to the top of the T-shaped rod, a connecting plate is inserted into the gap between a lower end face of the supporting plate and an upper end face of the supporting block, a through hole is formed in the T-shaped rod and located at the gap between the supporting plate and the supporting block, and a linkage unit is provided on the inner wall of the through hole.

Furthermore, a rectangular hole, inside which the T-shaped rod is located, is provided at the internal center of the connecting plate, and triangular extrusion blocks are welded to the inner wall of the rectangular hole at equal intervals.

Furthermore, the linkage unit includes a positioning block fixedly installed at the top of the through hole by spot welding, a linkage plate is hinged on one side of the positioning block, and a roller shaft is installed at the bottom of the linkage plate.

Furthermore, a limiting block is welded to the top, close to the rectangular hole, of the connecting plate, and a limiting groove is arranged at the joint between a lower end face of the supporting plate and the limiting block.

Furthermore, a positioning groove is provided in the supporting block located at the middlemost position of the drive rod, and a disc is welded to the joint between the outer wall of the drive rod and the positioning groove.

Furthermore, a track groove is formed at the top of the supporting plate located at the extreme ends of the drive rod, and an arc track plate is welded to the inner wall of the positioning plate and forms a matching structure with the track groove.

Additionally, the present invention further provides a sorting method for the photoelectric coal and gangue sorting device, which includes the following specific steps:

S1. sieving of pulverized coal: the photoelectric coal and gangue sorting device is erected below coal mining conveying equipment, a driving mechanism is manually controlled to drive a sieving mechanism, and a mixture of coal, gangue and pulverized coal is conveyed to the sieving mechanism by conveying equipment, through which pulverized coal is sieved;

S2. material transfer: after S1, the remaining coal and gangue slide along the sieving mechanism onto a separating and conveying mechanism, while part of coal and gangue are stacked on the separating and conveying mechanism;

S3. separating and spreading of coal and gangue: the separating and conveying mechanism is manually controlled to enter a working state, and part of coal and gangue stacked on the separating and conveying mechanism are separated and spread into a single layer by means of the separating and conveying mechanism; and S4. identification and sorting: the separating and conveying mechanism continues to work, and drives a single layer of coal and gangue to fall from one end of the separating and conveying mechanism, while the sorting unit enters a working state to identify the coal and gangue, and sort the identified coal and gangue.

The advantageous effects of the present invention are as follows:

1. According to the photoelectric coal and gangue sorting device and the sorting method therefor provided by the present invention, sufficient components such as supporting blocks and supporting plates are designed compared with traditional belt conveyors. Several supporting plates form a coal and gangue conveying platform, and are made into a larger platform by changing relative lengths of several supporting blocks in the conveying process. Coal and gangue are driven to fall by means of self-friction on the surface of the supporting plates, so that stacked coal and gangue are separated and spread into a single layer. The single layer of coal and gangue will not be ghosted after falling from the supporting plates, which effectively increases the separation accuracy of the sorting unit.

2. According to the photoelectric coal and gangue sorting device and the sorting method therefor provided by the present invention, such members as triangular extrusion blocks and linkage units are provided. When several supporting blocks move, adjacent supporting blocks are driven by the self-movement of the supporting blocks as a driving force, making the supporting plates vibrate relative to the supporting blocks. In case the friction force at the upper end face of the connecting plate is insufficient to drive coal and gangue to move, the stacked coal and gangue can also be separated and spread into a single layer by the shaking accompanied with vibration, thereby further ensuring that coal and gangue will not be ghosted before the identification and sorting step.

3. According to the photoelectric coal and gangue sorting device and the sorting method therefor provided by the present invention, such members as a sieving mechanism and a driving mechanism are provided. Before coal and gangue are sorted, the driving mechanism is controlled to drive the sieving mechanism, so as to achieve the rapid separation of pulverized coal, which avoids a large amount of dust in subsequent procedures and provides a safer working environment.

BRIEF DESCRIPTION OF THE DRAWINGS

The present invention will be further described in combination with drawings and embodiments.

DETAILED DESCRIPTION OF THE PREFERRED EMBODIMENT

To make more clearly the technical problems, technical solutions and advantageous effects of the present invention, the present invention will be further described in detail with reference to the drawings and embodiments. It should be understood that the specific embodiments described herein are for the purpose of describing the present invention only, but not intended to be limiting of the same.

Figure 1:
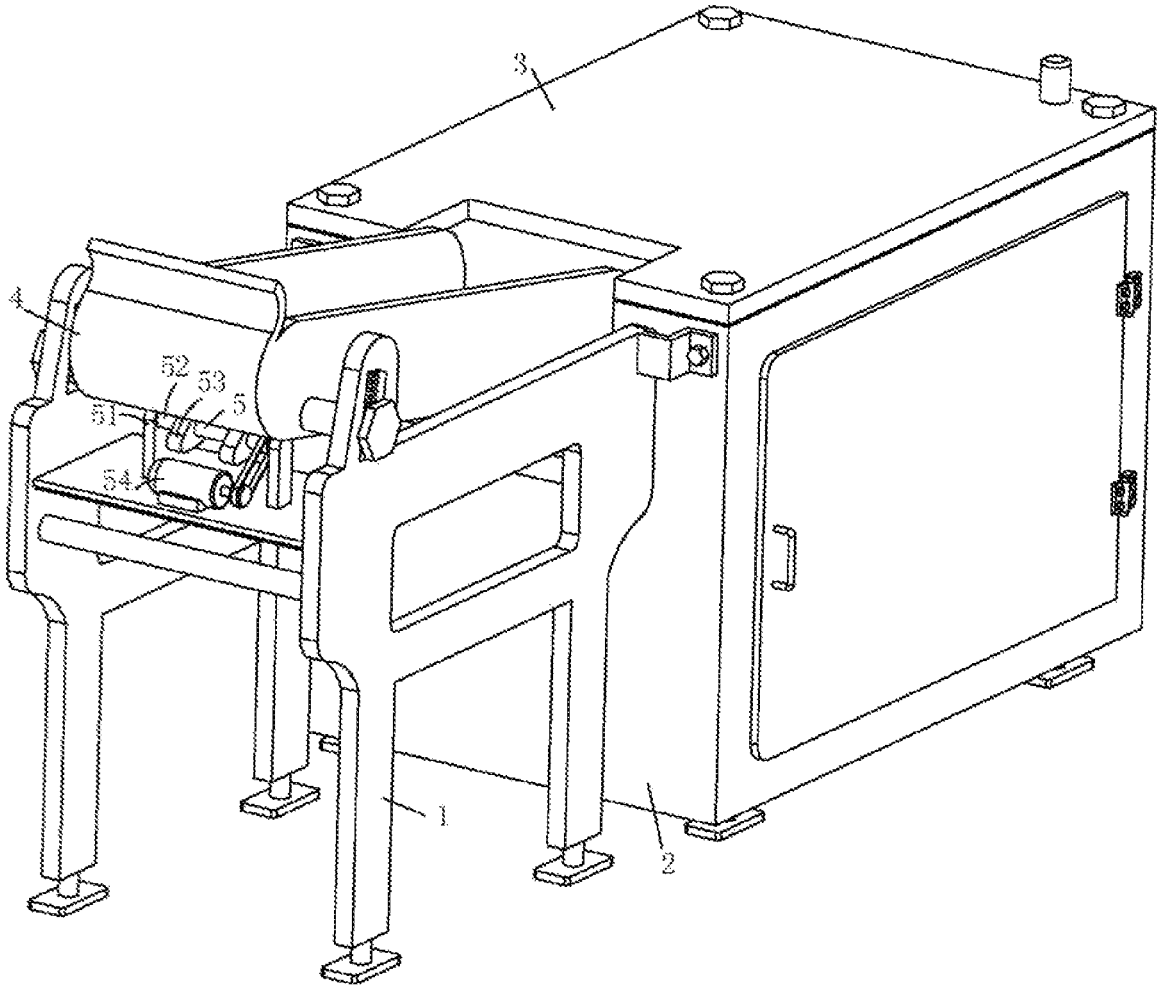
FIG. 1 is a perspective view of the overall structure of the present invention.
Figure 2:
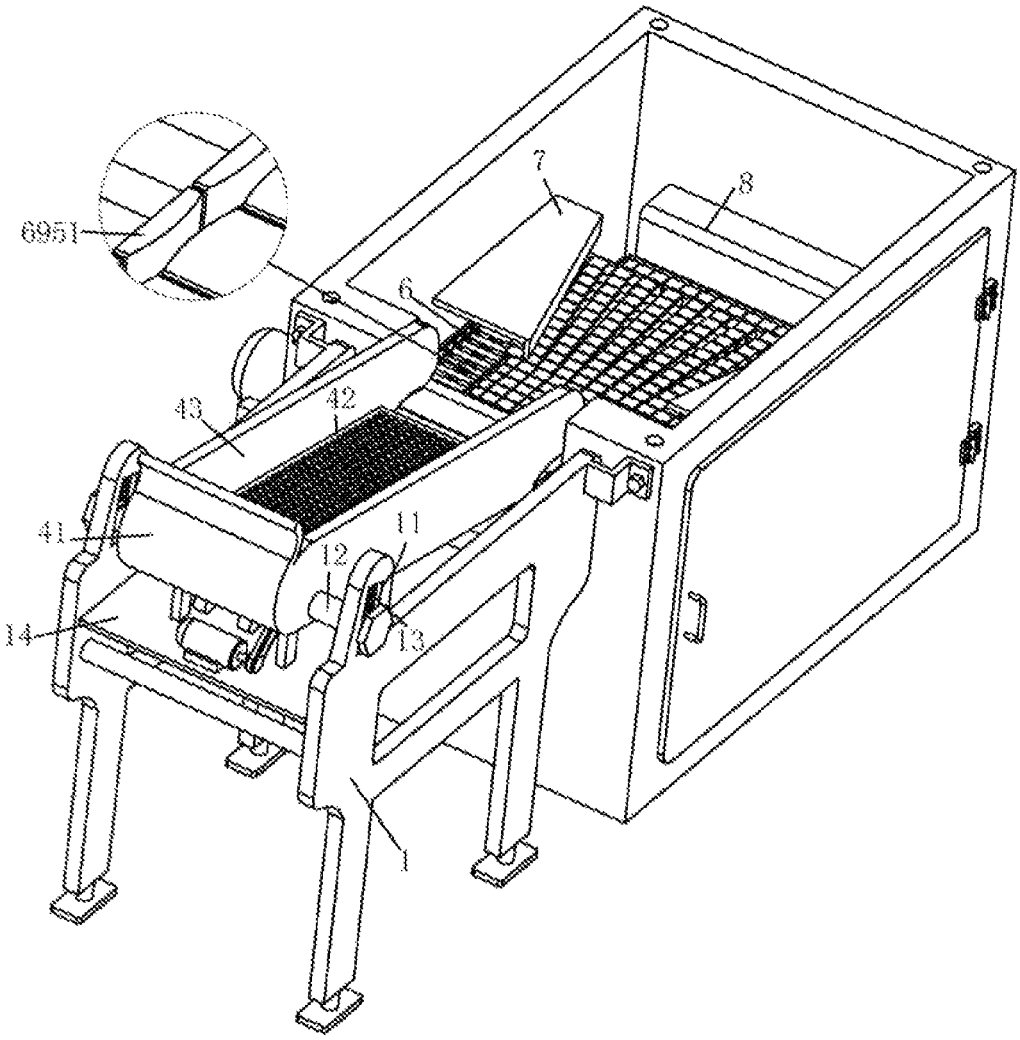
FIG. 2 is a first perspective view of the present invention without the sealing upper cover installed.
Figure 3:
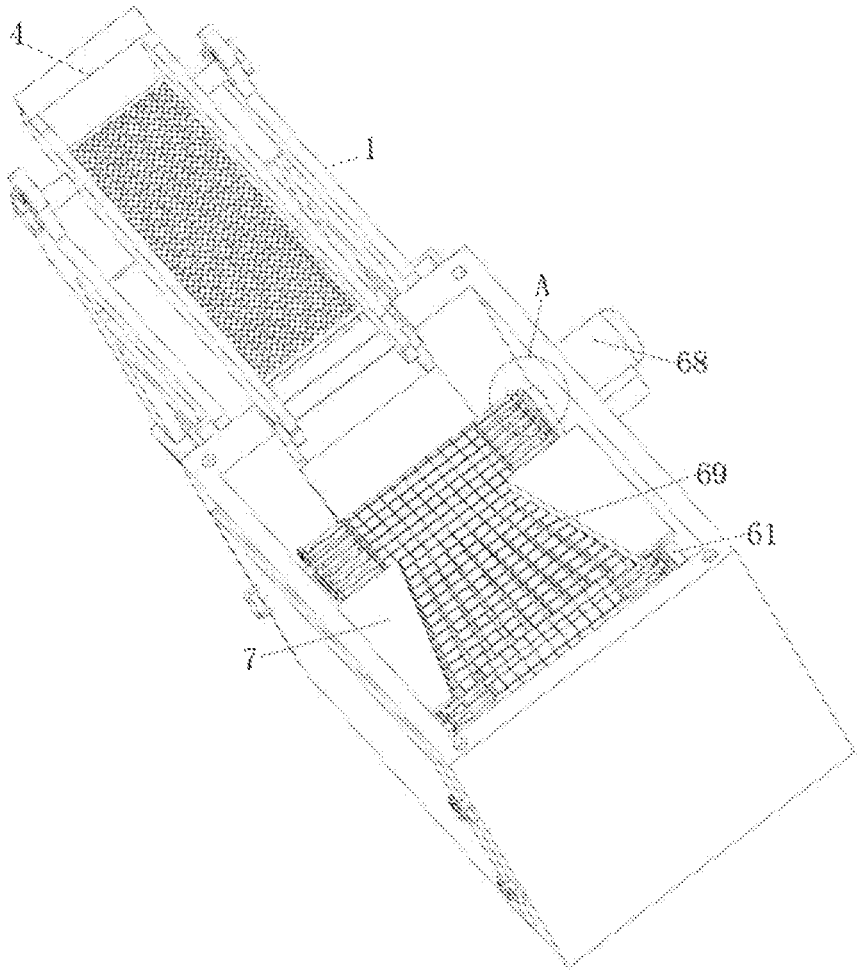
FIG. 3 is a second perspective view of the present invention without the sealing upper cover installed.
Figure 4:
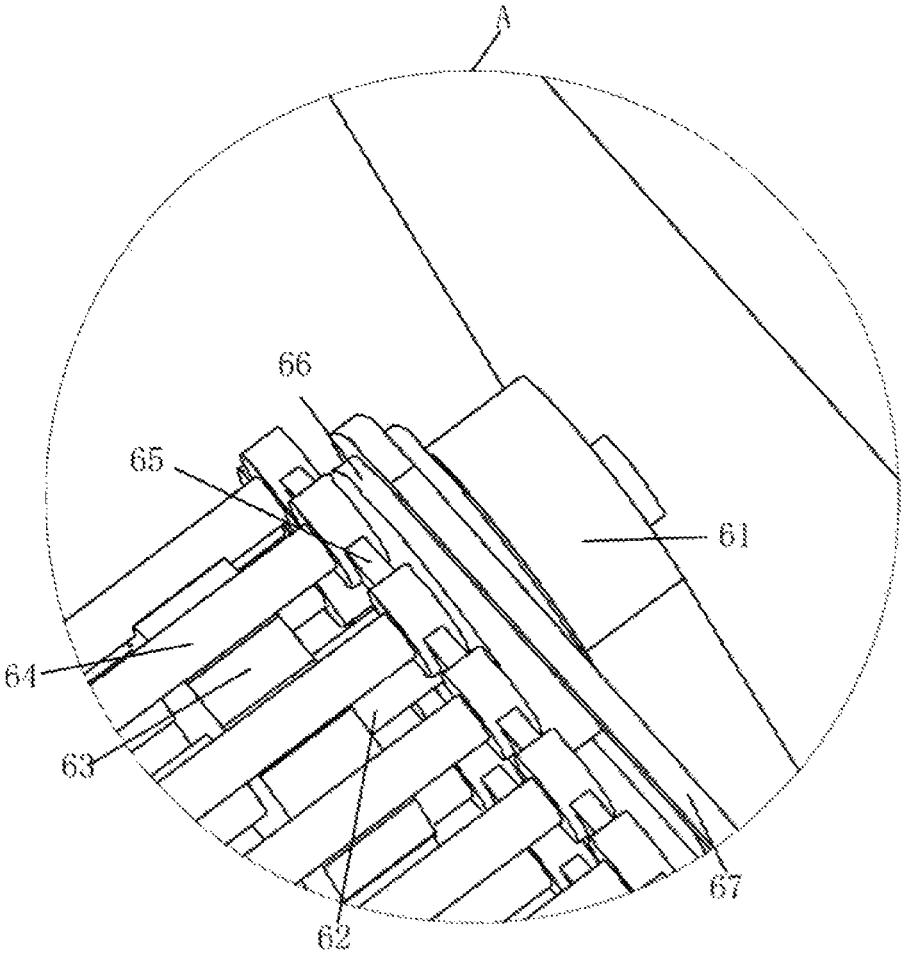
FIG. 4 is an enlarged view of area A in FIG. 3 of the present invention.
Figure 5:
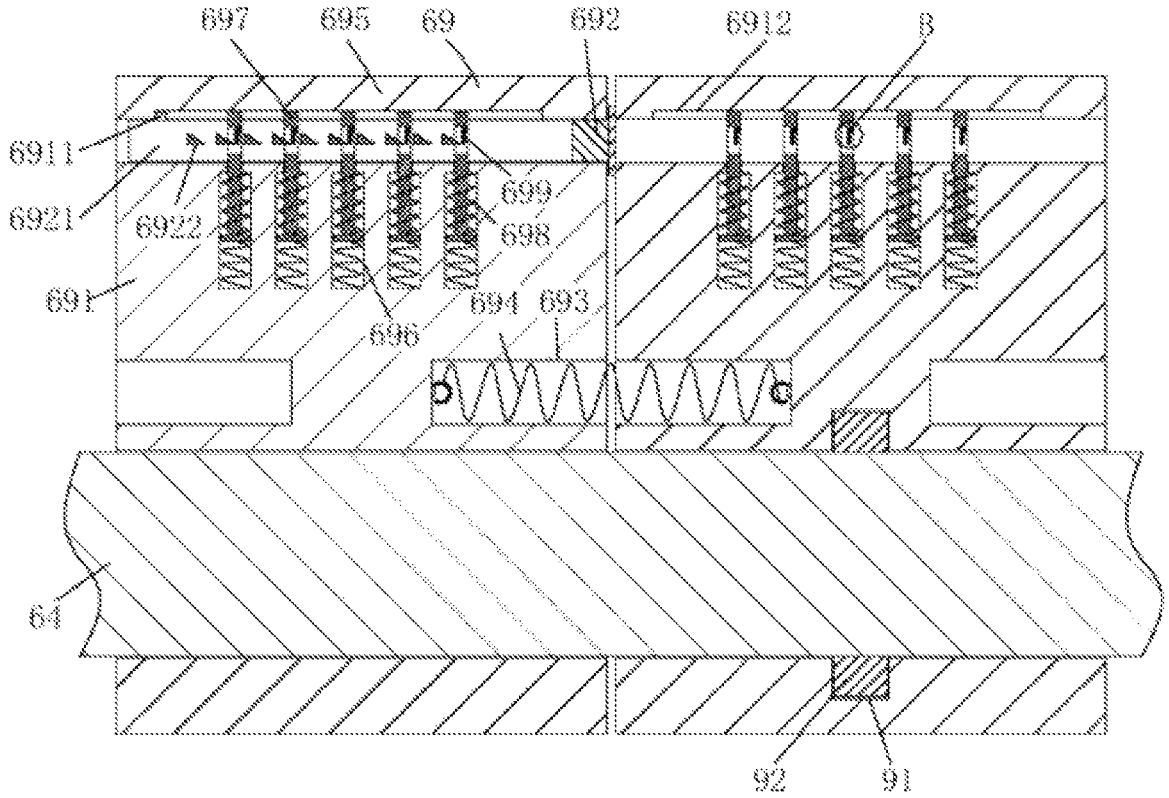
FIG. 5 is a sectional view of two adjacent supporting assemblies of the present invention.
Figure 6:
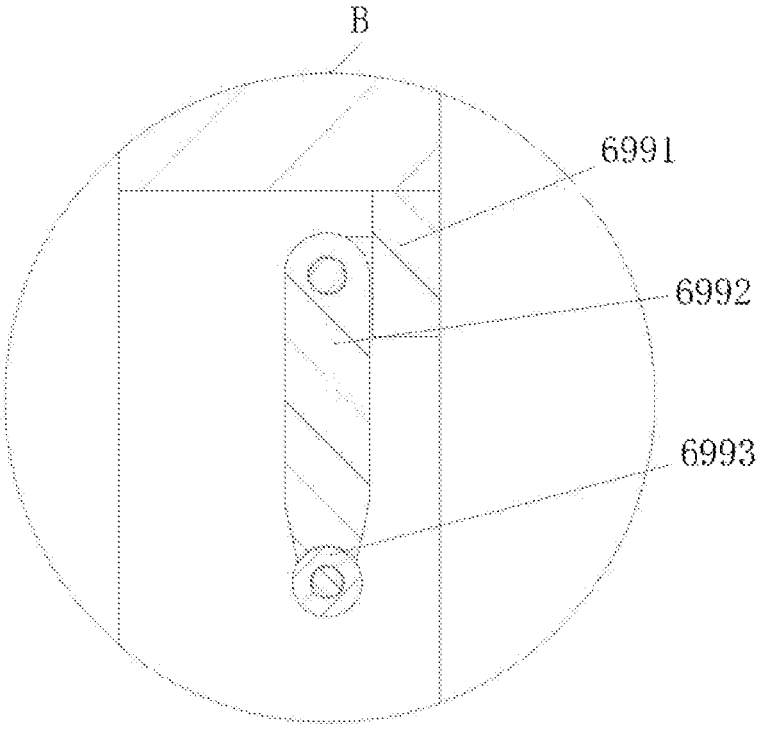
FIG. 6 is an enlarged view of area B in FIG. 5 of the present invention.
Figure 7:
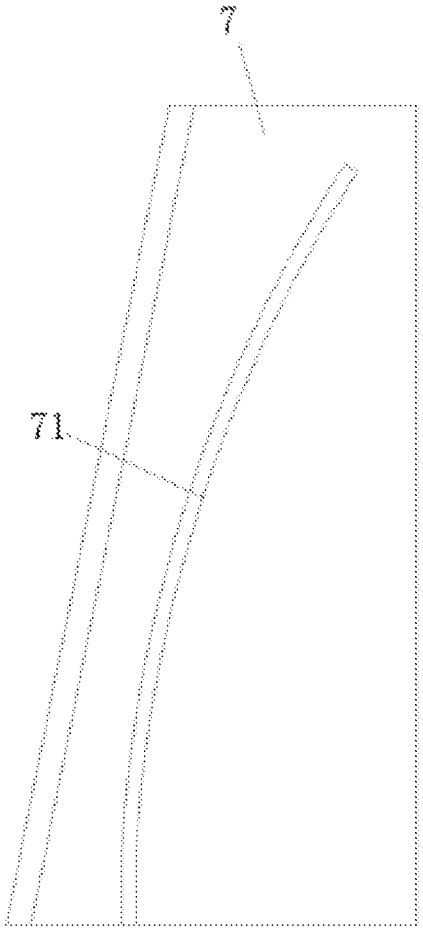
FIG. 7 is a bottom view of the positioning plate of the present invention.
Figure 8:
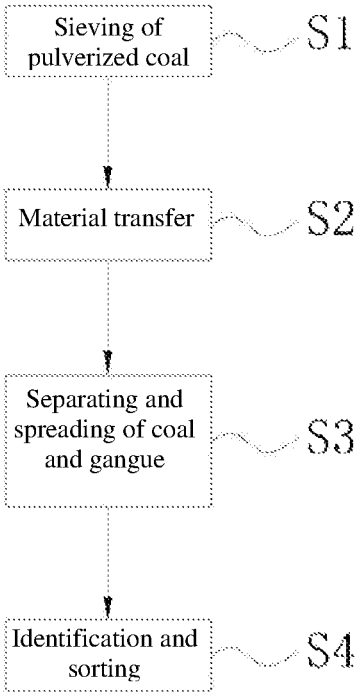
FIG. 8 is a flowchart of the present invention.

As shown in FIGS. 1 to 8, a photoelectric coal and gangue sorting device includes a support frame 1, a coal and gangue separation screen body 2, a sealing upper cover 3, a sieving mechanism 4, a driving mechanism 5, a separating and conveying mechanism 6, a positioning plate 7 and a sorting unit 8. The coal and gangue separation screen body 2, on the top of which is provided with the sealing upper cover 3 and inside of which is provided with the separating and conveying mechanism 6, is fixedly installed on one side of the support frame 1 by means of bolts; the side wall of the positioning plate 7, which is arranged above the separating and conveying mechanism 6, is fixed to the inner wall of the coal and gangue separation screen body 2 by means of spot welding; the sorting unit 8 is installed on the right side of the separating and conveying mechanism 6 inside the coal and gangue separation screen body 2; and the top of the support frame 1 is provided with the sieving mechanism 4 at the bottom of which the driving mechanism 5 is installed.

The driving mechanism 5 includes shaft brackets 51 symmetrically welded to an upper end face of the reinforcing plate 14, a rotating shaft 52 is arranged between the two shaft brackets 51 and cams 53 are symmetrically welded to the outer wall of the rotating shaft 52, a first motor 54 is arranged on one side of the shaft bracket 51 and fixed on an upper end face of the reinforcing plate 14 by means of a motor fixing frame, and an output shaft of the first motor 54 is connected to the rotating shaft 52 by means of a synchronous belt; and the first motor 54 is manually controlled to work, and drives the rotating shaft 52 which drives the cam 53 to rotate together.

The sieving mechanism 4 includes a sieving hopper 41 with one end welded to an end face of the linkage rod 12 and the other end connected to a top corner of the coal and gangue separation screen body 2 by means of a shaft lever, a sieve 42 is welded at the middle position of the inner wall of the sieving hopper 41, and a leakage hole 43 is formed at the bottom of the sieving hopper 41. The cams 53 rotate and intermittently generate an extrusion force on the bottom of the sieving hopper 41, causing the sieving hopper 41 to deflect reciprocally along the shaft lever. When the mixture of coal, gangue and pulverized coal is delivered to the sieving hopper 41, pulverized coal will be shaken out from the inside of the sieve 42, achieving the separation of pulverized coal. Correspondingly, a large amount of dust will not be raised in subsequent processing, and the working environment becomes safer. Due to an angle of inclination of the sieving hopper 41, the sieved coal and gangue slide down to the separating and conveying mechanism 6 under their own gravity, and some will be stacked on the separating and conveying mechanism 6 at high sliding rate.

An arc hole 11, into which a linkage rod 12 is inserted, is formed on the top of the support frame 1, a reset spring 13 is welded to the outer wall of the linkage rod 12, the top of the reset spring 13 is welded to the top of the arc hole 11, and a reinforcing plate 14 is welded to the inner side of the support frame 1. When the sieving hopper 41 deflects, the linkage rod 12 will slide along the arc hole 11 to squeeze the reset spring 13, which is compressed to generate a resilience force acting on the linkage rod 12 in the opposite direction, which restricts the position of the sieving hopper 41 to ensure that the lower end face of the sieving hopper 41 always clings to the outer wall of the cam 53.

The separating and conveying mechanism 6 includes fixing side plates 61 bolted to the bottom end inside the coal and gangue separation screen body 2, driving discs 63 are symmetrically welded to the outer wall of a rotating shaft 62 arranged between the two fixing side plates 61, semicircular grooves are provided on outer walls of the driving discs 63 at equal intervals in a circumferential direction, an upper end of the semicircular groove is provided with a drive rod 64 of which the outer wall is sleeved with supporting assemblies 69 side by side, ends of any two adjacent drive rods 64 are connected by means of a rubber block 65, driving gears 66 are welded to outer walls of the two rotating shafts 62 and connected by means of a driving chain 67, the second motor 68 is fixed on the outer wall of the coal and gangue separation screen body 2 by means of a motor fixing frame, and the output shaft of the second motor 68 penetrates through the coal and gangue separation screen body 2 and is connected to the rotating shaft 62. Specifically, the second motor 68 is manually controlled to enter the working state, one rotating shaft 62, one driving disc 63 and one driving gear 66 are driven to rotate by the second motor 68, and the other rotating shaft 62 and the other driving disc 63 are driven to rotate by the driving chain 67. When the two driving discs 63 rotate, several drive rods 64*s* are driven to rotate and move the supporting assembly 69. Finally, coal and gangue are transported to one end of the sorting unit 8 by means of the supporting assembly 69.

Furthermore, a track groove 6951 is formed at the top of the supporting plate 695 located at the extreme ends of the drive rod 64, and an arc track plate 71 is welded to the inner wall of the positioning plate 7 and forms a matching structure with the track groove 6951. When the supporting assembly 69 moves to a certain distance, the track groove 6951 at the top of the supporting plate 695 located at the extreme ends of the drive rod 64 will drive into the arc track plate 71, which then applies an axial tension to the rotating supporting plate 695.

Furthermore, the supporting assembly 69 includes several supporting blocks 691 sleeved on the outer wall of the drive rod 64 side by side, a tension spring 694 is arranged between rectangular grooves 693 symmetrically provided on two side walls of the supporting block 691, T-shaped rods 697 are arranged on inner walls of convex grooves 696 formed at the top of the bearing block 691 at equal intervals, supporting springs 698 are symmetrically provided on one end of the T-shaped rod 697 located in the convex grooves 696, a supporting plate 695 is welded to the top of the T-shaped rod 697, a connecting plate 692 is inserted into the gap between a lower end face of the supporting plate 695 and an upper end face of the supporting block 691, a through hole is formed in the T-shaped rod 697 and located at the gap between the supporting plate 695 and the supporting block 691, and a linkage unit 699 is provided on the inner wall of the through hole. Specifically, when the supporting plate 695 receives the axial tension exerted by the arc track plate 71, the supporting plate 695 located at the extreme ends of the drive rod 64 will drive the supporting block 691 to slide along the outer wall of the drive rod 64, and then the supporting block 691 here will pull adjacent supporting block 691 under the action of the tension spring 694. Meanwhile, the tension spring 694 is in an elongated state and has a resilience force, that is, relative length of several supporting blocks 691 arranged on the same drive rod 64 increases with the driving distance of the track groove 6951 on the arc track plate 71, a gap occurs between adjacent supporting blocks 691, relative supporting area between the supporting blocks 691 increases, and the connecting plate 692 is exposed. The top surface of the supporting plate 695 is relatively rough, making the coal and gangue stacked on the upper end face of the supporting plate 695 move with the supporting plate 695 under the action of friction when the supporting plate 695 moves along with the supporting block 691. With coal and gangue moving, the coal and gangue stacked at the upper end of the bottom layer will lose the supporting force of the coal and gangue at the bottom layer, and then fall into the upper end of the connecting plate 692, making the stacked coal and gangue be separated and spread into a single layer. In this way, after the single layer of coal and gangue fall from the supporting plate 695, no ghosting will occur, which effectively increases the sorting precision of the sorting unit 8. As the track groove 6951 drives away from the arc track plate 71, the supporting block 691 will be driven to reset along the drive rod 64 under the action of a resilience force generated by the elongation of the tension spring 694.

A rectangular hole 6921, inside which the T-shaped rod 697 is located, is provided at the internal center of the connecting plate 692, and triangular extrusion blocks 6922 are welded to the inner wall of the rectangular hole 6921 at equal intervals. The connecting plate 692 is exposed, that is, the connecting plate 692 slides at the gap between the supporting plate 695 and the supporting block 691. The connecting plate 692 slides and drives the triangular extrusion block 6922 to move together, making the inclined surface of the triangular extrusion block 6922 slide along the linkage unit 699. The triangular pressing block 6922 applies a vertical upward extrusion force to the linkage unit 699, by which the T-shaped rod 697 is driven to rise along the convex groove 696 and the supporting spring 698 is compressed by the T-shaped rod 697 to generate a resilience force. The T-shaped rod 697 loses the extrusion force of the triangular extrusion block 6922 as soon as the triangular extrusion block 6922 is separated from the linkage unit 699. Then the resilience force generated by the compression of the supporting spring 698 will drive the T-shaped rod 697 to instantly reset along the convex groove 696, so that the connecting plate 692 vibrates vertically relative to the supporting block 691.

Each time the triangular extrusion block 6922 is in contact with and separated from the triangular extrusion block 6922, the connecting plate 692 vibrates relative to the supporting block 691. In this way, the coal and gangue on the upper end surface of the connecting plate 692 can be driven to shake by the relative shaking effect. In case the friction force at the upper end face of the connecting plate 692 is insufficient to drive coal and gangue to move, the stacked coal and gangue can also be separated and spread into a single layer by the shaking accompanied with vibration, thereby further ensuring that coal and gangue will not be ghosted before the identification and sorting step.

The linkage unit 699 includes a positioning block 6991 fixedly installed at the top of the through hole by spot welding, a linkage plate 6992 is hinged on one side of the positioning block 6991, and a roller shaft 6993 is installed at the bottom of the linkage plate 6992. When the connecting plate 692 vibrates relative to the supporting block 691, the inclined surface of the triangular extrusion block 6922 slides against the roller shaft 6993. By this time, the side wall of the linkage plate 6992 is closely attached to the side wall of the positioning block 6991 to ensure that the triangular extrusion block 6922 can normally squeeze the linkage plate 6992 when moving. When the supporting block 691 is driven to reset along the drive rod 64 under the action of a resilience force generated by the elongation of the tension spring 694, the vertical surface of the triangular extrusion block 6922 will be in direct contact with the linkage plate 6992, which will deflect along the positioning block 6991 under the pressing force of the triangular extrusion block 6922, so as to ensure that the supporting block 691 can be properly reset.

A limiting block 6911 is welded to the top, close to the rectangular hole 6921, of the connecting plate 692, and a limiting groove 6912 is arranged at the joint between a lower end face of the supporting plate 695 and the limiting block 6911. The limiting block 6911 slides in the limiting groove 6912 while the supporting block 691 slides along the drive rod 64. The sliding distance between two adjacent supporting blocks 691 is limited by the limiting block 6911 and the limiting groove 6912, so that the connecting plate 692 is separated from the gap between the supporting plate 695 and the supporting block 691.

A positioning groove 91 is provided in the supporting block 691 located at the middlemost position of the drive rod 64, and a disc 92 is welded to the joint between the outer wall of the drive rod 64 and the positioning groove 91, which arrangement ensures that the supporting block 691 located in the middle of the drive rod 64 does not move, and correspondingly, the supporting blocks 691 at other positions are uniformly stressed.

Additionally, the present invention further provides a sorting method for the photoelectric coal and gangue sorting device, which includes the following specific steps:

S1. sieving of pulverized coal: the photoelectric coal and gangue sorting device is erected below coal mining conveying equipment, a driving mechanism 5 is manually controlled to drive a sieving mechanism 4, and a mixture of coal, gangue and pulverized coal is conveyed to the sieving mechanism 4 by conveying equipment, through which pulverized coal is sieved;

S2. material transfer: after S1, the remaining coal and gangue slide along the sieving mechanism 4 onto a separating and conveying mechanism 6, while part of coal and gangue are stacked on the separating and conveying mechanism 6;

S3. separating and spreading of coal and gangue: the separating and conveying mechanism 6 is manually controlled to enter a working state, and part of coal and gangue stacked on the separating and conveying mechanism 6 are separated and spread into a single layer by means of the separating and conveying mechanism 6; and S4. identification and sorting: the separating and conveying mechanism 6 continues to work, and drives a single layer of coal and gangue to fall from one end of the separating and conveying mechanism 6, while the sorting unit 8 enters a working state to identify the coal and gangue, and sort the identified coal and gangue.

The basic principles, main features and advantages of the present invention are shown and described above. However, one of ordinary skill in the art should understand that the embodiments and the specification are intended to illustrate the principles of the present invention, but should not be construed as a limit thereto. Various variations and improvements can be made without departing from the spirit and scope of the present invention, all of which should fall within the scope of protection as claimed in the present invention. The scope of protection as claimed in the present invention is defined by the appended claims and their equivalents.

The invention claimed is:

1. A photoelectric coal and gangue sorting device, comprising a support frame (1), a coal and gangue separation screen body (2), a sealing upper cover (3), a sieving mechanism (4), a driving mechanism (5), a separating and conveying mechanism (6), a positioning plate (7) and a sorting unit (8), wherein the coal and gangue separation screen body (2), on the top of which is provided with the sealing upper cover (3) and inside of which is provided with the separating and conveying mechanism (6), is fixedly installed on one side of the support frame (1) by means of bolts; the side wall of the positioning plate (7), which is arranged above the separating and conveying mechanism (6), is fixed to the inner wall of the coal and gangue separation screen body (2) by means of spot welding; the sorting unit (8) is installed on the right side of the separating and conveying mechanism (6) inside the coal and gangue separation screen body (2); and the top of the support frame (1) is provided with the sieving mechanism (4) at the bottom of which the driving mechanism (5) is installed;

an arc hole (11), into which a linkage rod (12) is inserted, is formed on the top of the support frame (1), a reset spring (13) is welded to the outer wall of the linkage rod (12), the top of the reset spring (13) is welded to the top of the arc hole (11), and a reinforcing plate (14) is welded to the inner side of the support frame (1);

the sieving mechanism (4) comprises a sieving hopper (41) with one end welded to an end face of the linkage rod (12) and the other end connected to a top corner of the coal and gangue separation screen body (2) by means of a shaft lever, a sieve (42) is welded at the middle position of the inner wall of the sieving hopper (41), and a leakage hole (43) is formed at the bottom of the sieving hopper (41);

the driving mechanism (5) comprises shaft brackets (51) symmetrically welded to an upper end face of the reinforcing plate (14), a rotating shaft (52) is arranged between the two shaft brackets (51) and cams (53) are symmetrically welded to the outer wall of the rotating shaft (52), a first motor (54) is arranged on one side of the shaft bracket (51) and fixed on an upper end face of the reinforcing plate (14) by means of a motor fixing frame, and an output shaft of the first motor (54) is connected to the rotating shaft (52) by means of a synchronous belt;

the separating and conveying mechanism (6) comprises fixing side plates (61) bolted to the bottom end inside the coal and gangue separation screen body (2), driving discs (63) are symmetrically welded to the outer wall of a rotating shaft (62) arranged between the two fixing side plates (61), semicircular grooves are provided on outer walls of the driving discs (63) at equal intervals in a circumferential direction, an upper end of the semicircular grooves is provided with a drive rod (64) of which the outer wall is sleeved with supporting assemblies (69) side by side, ends of any two adjacent drive rods (64) are connected by means of a rubber block (65), driving gears (66) are welded to outer walls of the two rotating shafts (62) and connected by means of a driving chain (67), the second motor (68) is fixed on the outer wall of the coal and gangue separation screen body (2) by means of a motor fixing frame, and the output shaft of the second motor (68) penetrates through the coal and gangue separation screen body (2) and is connected to the rotating shaft (62);

a supporting assembly (69) comprises one or more supporting blocks (691) sleeved on the outer wall of the drive rod (64) side by side, a tension spring (694) is arranged between rectangular grooves (693) symmetrically provided on two side walls of the one or more supporting blocks (691), T-shaped rods (697) are arranged on inner walls of convex grooves (696) formed at the top of a bearing block (691) at equal intervals, supporting springs (698) are symmetrically provided on one end of the T-shaped rod (697) located in the convex grooves (696), a supporting plate (695) is welded to the top of the T-shaped rod (697), a connecting plate (692) is inserted into the gap between a lower end face of the supporting plate (695) and an upper end face of the one or more supporting blocks (691), a through hole is formed in the T-shaped rod (697) and located at the gap between the supporting plate (695) and the one or more supporting blocks (691), and a linkage unit (699) is provided on the inner wall of the through hole; a track groove (6951) is formed at the top of the supporting plate (695) located at the extreme ends of the drive rod (64), and an arc track plate (71) is welded to the inner wall of the positioning plate (7) and forms a matching structure with the track groove (6951); when the supporting assembly (69) moves to a certain distance, the track groove (6951) at the top of the supporting plate (695) located at the extreme ends of the drive rod (64) will drive into the arc track plate (71), which then applies an axial tension to the rotating supporting plate (695); as the track groove (6951) drives away from the arc track plate (71), the one or more supporting blocks (691) will be driven to reset along the drive rod (64) under the action of the resilience force generated by the elongation of the tension spring (694).

2. The photoelectric coal and gangue sorting device according to claim 1, wherein a rectangular hole (6921), inside which the T-shaped rod (697) is located, is provided at the internal center of the connecting plate (692), and triangular extrusion blocks (6922) are welded to the inner wall of the rectangular hole (6921) at equal intervals.

3. The photoelectric coal and gangue sorting device according to claim 2, wherein the linkage unit (699) comprises a positioning block (6991) fixedly installed at the top of the through hole by spot welding, a linkage plate (6992) is hinged on one side of the positioning block (6991), and a roller shaft (6993) is installed at the bottom of the linkage plate (6992).

4. The photoelectric coal and gangue sorting device according to claim 3, wherein a limiting block (6911) is welded to the top, close to the rectangular hole (6921), of the connecting plate (692), and a limiting groove (6912) is arranged at the joint between a lower end face of the supporting plate (695) and the limiting block (6911).

5. The photoelectric coal and gangue sorting device according to claim 1, wherein a positioning groove (91) is provided in the one or more supporting blocks (691) located at the middlemost position of the drive rod (64), and a disc (92) is welded to the joint between the outer wall of the drive rod (64) and the positioning groove (91).

6. The photoelectric coal and gangue sorting device according to claim 1, wherein the photoelectric coal and gangue sorting device is configured to be used in a sorting method comprising the following steps:

S1. sieving of pulverized coal: the photoelectric coal and gangue sorting device is erected below coal mining conveying equipment, the driving mechanism (5) is manually controlled to drive the sieving mechanism (4), and a mixture of coal, gangue and pulverized coal is conveyed to; the sieving mechanism (4) by conveying equipment, through which pulverized coal is sieved;

S2. material transfer: after S1, the remaining coal and gangue slide along the sieving mechanism (4) onto the separating and conveying mechanism (6), while part of coal and gangue are stacked on the separating and conveying mechanism (6);

S3. separating and spreading of coal and gangue: the separating and conveying mechanism (6) is manually controlled to enter a working state, and part of coal and gangue stacked on the separating and conveying mechanism (6) are separated and spread into a single layer by means of the separating and conveying mechanism (6); and S4. identification and sorting: the separating and conveying mechanism (6) continues to work, and drives a single layer of coal and gangue to fall from one end of the separating and conveying mechanism (6), while the sorting unit (8) enters a working state to identify the coal and gangue, and sort the identified coal and gangue.

7. The method of claim 6, wherein a rectangular hole (6921), inside which the T-shaped rod (697) is located, is provided at the internal center of the connecting plate (692), and triangular extrusion blocks (6922) are welded to the inner wall of the rectangular hole (6921) at equal intervals.

8. The method of claim 6, wherein the linkage unit (699) comprises a positioning block (6991) fixedly installed at the top of the through hole by spot welding, a linkage plate (6992) is hinged on one side of the positioning block (6991), and a roller shaft (6993) is installed at the bottom of the linkage plate (6992).

9. The method of claim 8, wherein a limiting block (6911) is welded to the top, close to the rectangular hole (6921), of the connecting plate (692), and a limiting groove (6912) is arranged at the joint between a lower end face of the supporting plate (695) and the limiting block (6911).

10. The method of claim 6, wherein a positioning groove (91) is provided in the one or more supporting blocks (691) located at the middlemost position of the drive rod (64), and a disc (92) is welded to the joint between the outer wall of the drive rod (64) and the positioning groove (91).

* * * * *